United States Patent [19]

Bozinovich et al.

[11] Patent Number: 4,702,389

[45] Date of Patent: Oct. 27, 1987

[54] RIGID LID SYSTEM

[75] Inventors: Matthew J. Bozinovich, Libertyville; Robert M. Fontana, Niles, both of Ill.

[73] Assignee: Kraft, Inc., Glenview, Ill.

[21] Appl. No.: 414,463

[22] Filed: Sep. 2, 1982

Related U.S. Application Data

[63] Continuation of Ser. No. 196,360, Oct. 14, 1980, abandoned.

[51] Int. Cl.[4] ..... B65D 43/10; B65D 5/68; B65D 21/02

[52] U.S. Cl. ..... 220/306; 206/508

[58] Field of Search ..... 220/306; 206/508

[56] References Cited

U.S. PATENT DOCUMENTS

| | | | |
|---|---|---|---|
| 3,179,283 | 4/1965 | Amberg | 220/306 |
| 3,269,588 | 8/1966 | Ruekberg | 220/306 |
| 4,051,951 | 10/1977 | Smith | 206/508 |

FOREIGN PATENT DOCUMENTS

| | | | |
|---|---|---|---|
| 230463 | 9/1960 | Austria | 220/306 |
| 1415739 | 9/1965 | France | 220/306 |

*Primary Examiner*—George E. Lowrance

*Attorney, Agent, or Firm*—Fitch, Even, Tabin & Flannery

[57] ABSTRACT

Rigid lid systems for wide mouthed containers for comestibles such as margarine and the like, which are adapted for stacking in shipping containers without interlayer sheets.

5 Claims, 5 Drawing Figures

RIGID LID SYSTEM

This is a continuation of application Ser. No. 196,360, filed Oct. 14, 1980, now abandoned.

The present invention relates to closures for containers. More particularly, the present invention relates to relatively rigid closures for containers such as margarine containers, a plurality of which may be packaged in cartons for storage or shipment.

Comestibles such as margarine, cream cheese dips and the like are conventionally packaged in cup-like containers having closures made of relatively resilient materials such as low or medium density polyethylene having a relatively low modulus of elasticity. Such lids are relatively flexible in construction to provide for ease of handling by the consumer. Relatively more rigid container like constructions unfortunately may provide difficulties in respect to ease of opening or reclosure by the consumer, or initial provision of a secure closure. In order to package a plurality of layers of containers utilizing conventional resilient lids, in stacked relation in a shipping or storage carton, interlayer dividing sheets are conventionally provided between layers of product containers to prevent container deformation which might otherwise occur, particularly of the lowermost containers. In this regard, the relatively flexible container lids may tend to deform under the weight of an overlying filled container, and may bend downward into the packaged product or suffer deformation of a packaging sleeve surrounding the container. Such damaged merchandise is undesirable to the consumer, and it is important to minimize such product damage during shipment or storage. However, the utilization of interlayer dividing sheets such as layers of cardboard or the like in conventional shipping containers has the disadvantages of increased expense in materials and material handling when dealing in large quantities of containers and packaging them, and it would be desirable to be able to package the containers without using such packaging interlayers.

Accordingly, it is an object of the present invention to provide a lid closure for a wide-mouthed comestible container having improved rigidity for packaging and shipping purposes, but which may also be effectively secured to an associated container, and which may be readily removed from and replaced on such container by the consumer.

Another object of the present invention is to provide a rigid lid or closure which when secured to an associated container cup will permit packaging of the assembled product containers in stacked relation without interlayer packaging sheets.

These and other objects of the invention will become more apparent with reference to the following detailed description and the accompanying drawings of which:

FIG. 4 is a side view of the lid of FIG. 1 taken along line 4—4 of FIG. 2.

Figure 1:
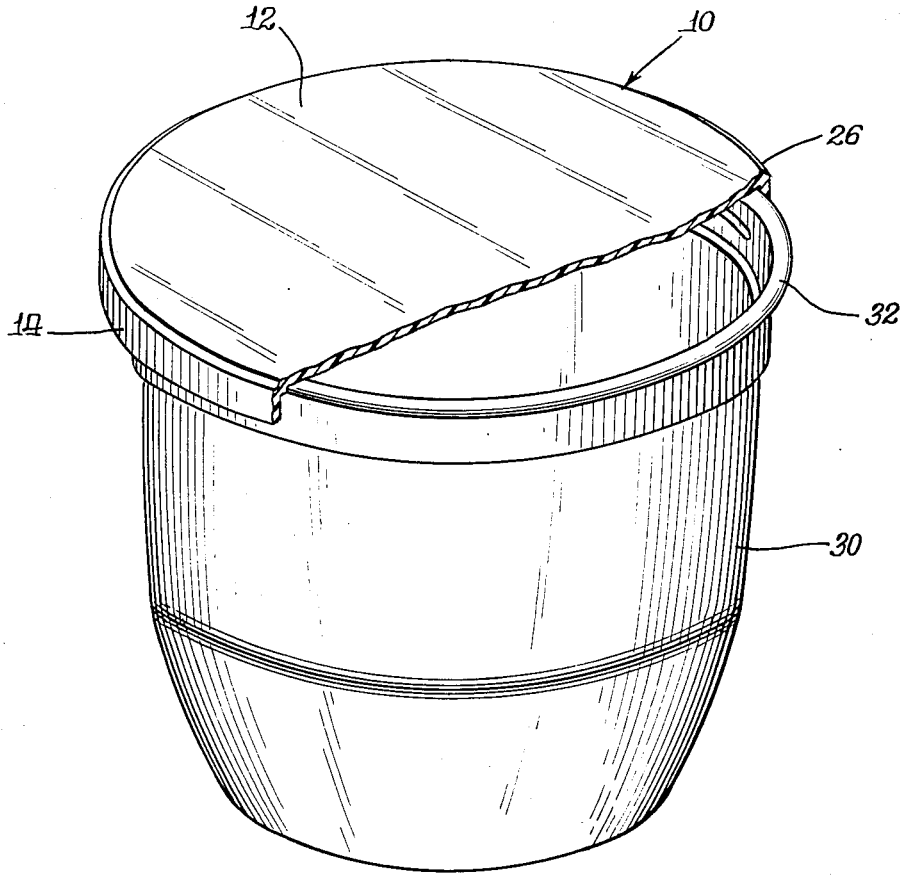
FIG. 1 is a perspective view of an embodiment of a rigid lid and container cup assembly in accordance with the present invention.

In accordance with the present invention, rigid lids of particular characteristics and construction are provided which are adapted to permit the stacking of closed containers without damaging the contents thereof. The lids are further adapted, despite their structural rigidity, to be readily and repeatedly removed from the associated container and yet provide a suitably secure closure.

More specifically, in accordance with the present invention, rigid one-piece organopolymeric lids for snap-on engagement with a mating wide mouthed container cup are provided which may readily be removed from and placed on the container cup.

In accordance with the invention, relatively rigid organopolymeric materials are utilized in the manufacture of the lids, and in this regard, suitable organopolymeric materials should have a flexural modulus of elasticity of at lest aboout $1.5\times10^5$ psi at ambient temperature, and preferably in the range of from about $1.75\times10^5$ to about $2.25\times10^5$ psi. Thermoplastic polypropylene polymers and copolymers have been found to be a particularly suitable materials for manufacture of rigid lids in accordance with the present invention, and are particularly preferred herein. The rigid organopolymeric lids are relatively wide, and comprise a generally circular central panel having a diameter in the range of from about 3 inches to about 6½ inches, and preferably in the range of from about 4 inches to about 5 inches. The central panel is preferably substantially planar but may be provided with raised or depressed portions in accordance with particular aesthetic or packaging requirements. The central panel is also preferably of substantially uniform thickness, but may similarly be formed with areas on nonuniform thickness such as radially oriented supporting ribs or molded surface designs for structural or aesthetic purposes. Rigid lids in accordance herewith are further provided with a radially continuous cylindrical skirt depending from the periphery of the central panel. The depending skirt element will preferably be of substantially uniform cylindrical shape, having an internal diameter approximating the outer diameter of the lip of the container cup which is intended to engage the lid. The length of the depending cylindrical skirt, in a cylindrically axial direction generally orthogonal to the central lid panel, will be at least sufficient to accommodate the thickness of the lip of the cup element intended to engage the lid, and the axial thickness of a radially interrupted bead which projects inwardly from the interior surface of depending skirt, and which will be described in more detail hereinafter.

As indicated, the lids in accordance herewith are of relatively rigid construction, and in this regard, should have certain flexural and compressional properties in respect to providing shipping properties to the assembled containers utilizing the lids. In this regard, the lids should require a force of at least about 6 pounds applied at a compression speed of 0.1 inch per minute to the center of the lid at ambient temperature to deflect the lid $\theta$ inch, when the lid is placed horizontally, in upright position, on supporting blocks spaced 2⅞" apart.

Furthermore, the lids should have a compressional flexural strength such that the maximum force applied by flat compression elements to a vertically aligned lid, is at least about 3 pounds at a compression speed of 0.1 inch per minute.

Further in accordance with the invention, as previously indicated, the cylindrical skirt is provided with an inwardly projecting bead spaced apart from the central panel. The bead is of radially uniformly interrupted design. Container cups utilized in combination with the lids of the present invention may be of conventional construction, and will generally comprise a container which may be constructed of a suitable thermoplastic material such as food-grade medium or high density polyethylene, having a circular opening with a radially outwardly projecting lip for engagement with the lid.

Figure 2:
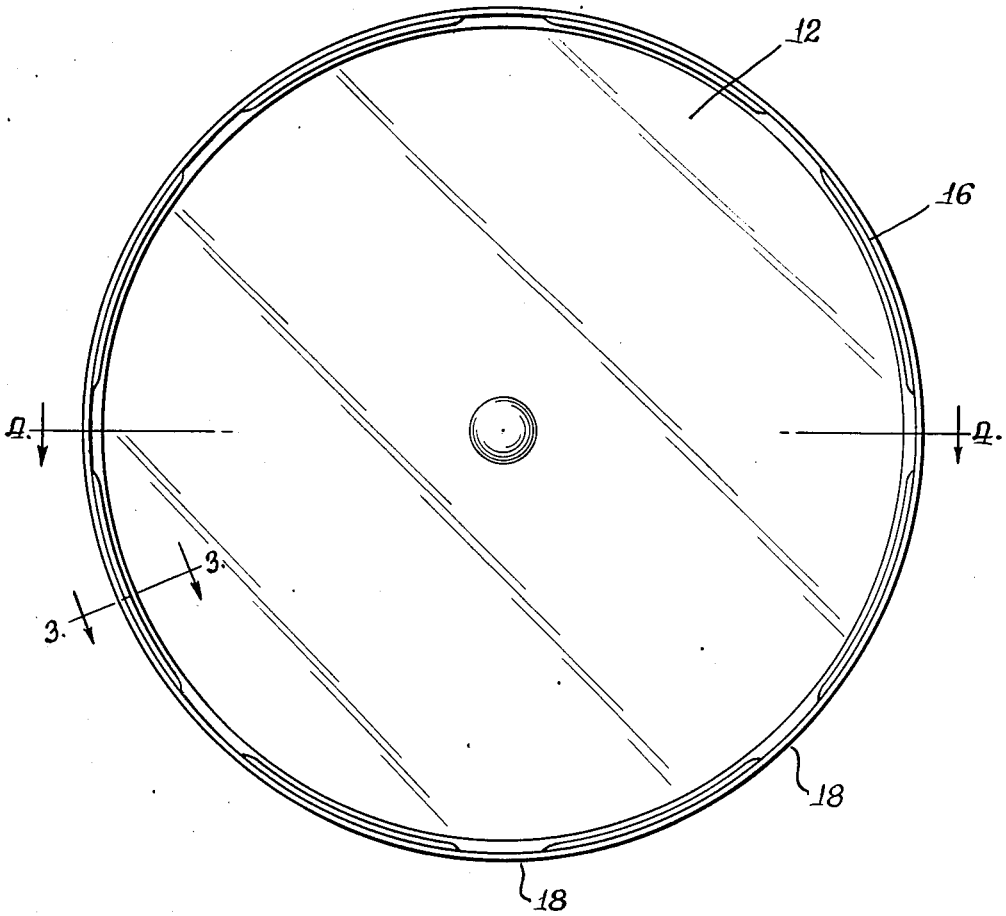
FIG. 2 is a bottom view of the lid embodiment of FIG. 1, illustrating the regularly interrupted bead of the lid.
Figure 3:
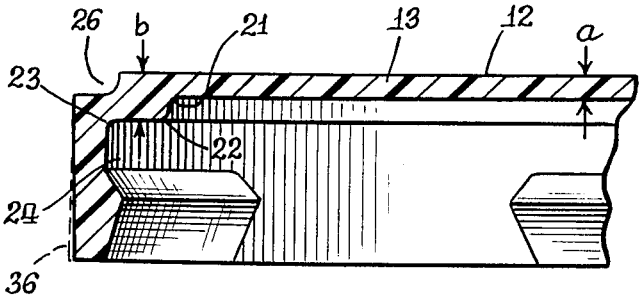
FIG. 3 is a partial exploded side view of the skirt of the lid of FIG. 1 taken along line 3—3 of FIG. 2.

Turning now to the drawings, the present invention will now be described in more detail with respect ot the specific embodiment 10 illustrated therein. In this regard, illustrated in perspective view in FIG. 1 is a lid embodiment 10 in assembled relationship in respect to wide mouthed container cup 30 engaged therewith, through interaction of the outwardly projecting lip 32 of the cup 30, and the inwardly projecting, interrupted bead 16 of the lid 10. Turning now to FIGS. 2, 3 and 4, which illustrates the lid 10 in substantially more detail, there is shown a round lid 10, which is injection molded of polypropylene copolymer sold by Hercules Incorporated under the Trade designation PRO-FAX SB-661 having a density (ASTM method D792A-2) of 0.905, a tensile strength at yield and an elongation at yield (ASTM D638 at 2 inches per minute) of 11 percent, a flexural modulus (1% secant) (ASTM method D790B, 2 inch span) of $1.85\times10^5$ psi, and a Rockwell hardness of 80. The illustrated lid 10 has a planar top 12 with a diameter of about 4.128 inches. A skirt 14 depends substantially orthogonally from the peripheral edge a distance of 0.212 inches from the bottom of the panel 12, and has an inner diameter of 4.155 inches and an outer diameter of about 4.235 inches. A wedge shaped bead 16 projects about 0.018 inch from the inner surface of the skirt 14. The bead 16 is interrupted, forming a plurality of regularly spaced, wedge shaped strips projecting from and along the length of the inner surface of the skirt 14 with the ratio of the length of the strips to the length of the skirt 14 being about 4 to 5 with the strips being preferably equally spaced, as at 18, from each other. Each end of the wedge shaped strips tapers to gradually join the inner surface of the skirt as at numeral 20, with a taper radius of 2 inches. The planar top 12 has a thin center section 13 to facilitate injection molding, and a thicker abutment section 15. In this regard, the bead is formed by a plurality of at least 6, and preferably from 8 to 10 bead elements projecting inwardly from the depending lid skirt to an inner diameter which is less than the outer diameter of the associated container cup. The bead elements forming the interrupted bead of the lid should be generally be in a plane parallel to but spaced apart from the plane of the central panel of the lid (to accommodate the cup lip), and are of sufficient length, in a direction along the inner circumference of the depending skirt of the lik to constitute from about 60 percent to about 90 percent and preferably from about 75 to about 80 percent of the internal circumference of the lid skirt. Moreover, the ends of the separate bead elements should preferably terminate gradually by tapering to the internal surface of the skirt in order to foster an effective resiliency in the application and removal characteristics of the lid in respect of the container cup.

As seen in FIG. 3, an abutment member 22, depends from the inner surface of top 12. The abutment member curvingly engages the inner surface of the top and the skirt 14 at 21 and 23, respectively. The wedge shaped bead element strips which project from the inner surface of the skirt 14 are spaced from the abutment member such that a channel 24 is formed along the inner surface of the skirt 14.

The surface of the illustrated wedge shaped bead which faces the abutment member tapers from the inner surface of the skirt 14 to an apex 28 at an angle about 35° from the vertical plane of the skirt 14. From the apex the bead tapers back toward the inner surface of the skirt 14 and continuously slopes toward the inner surface of the skirt 14 to a point were the skirt 14 terminates.

Figure 5:
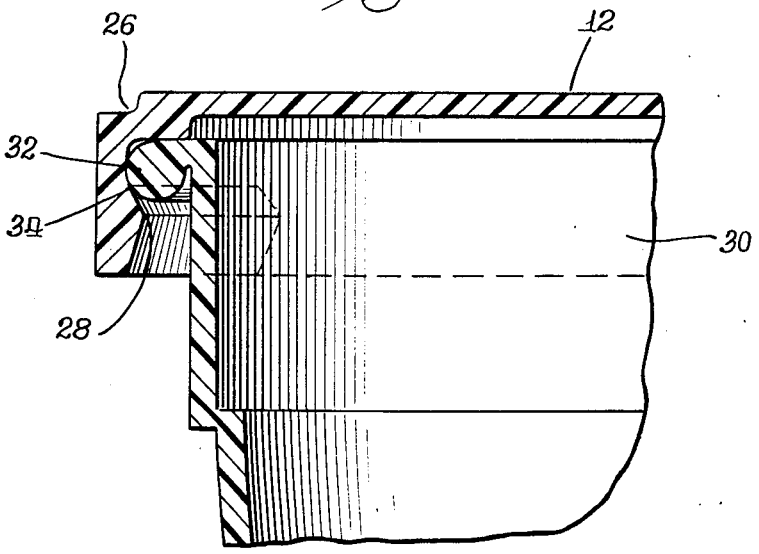
FIG. 5 is a partially exploded side view of the skirt of the lid associated with a suitable wide mouthed container cup.
Figure 1:
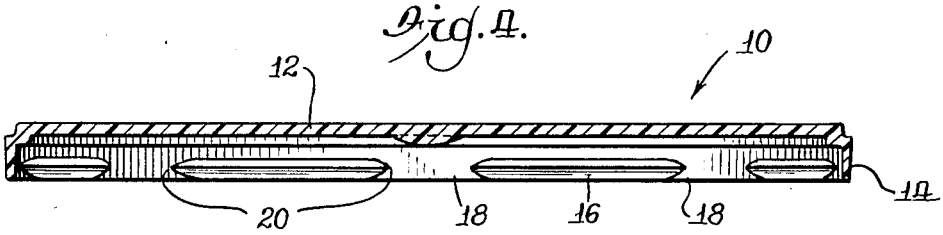

As seen in FIG. 5, the channel 24 formed intermediate the top panel 12 and the inwardly projecting, regularly interrupted bead 16 provides a seat for the top lip 32 of associated container 30 wherein the abutment member abuts the top surface of such top lip as at 34. The apex 28 and the surface inclining thereto abut against the lower surface of the top lip of such container thereby providing for a resilient snapping engagement with the associated container 30. To provide a means for stacking of lids for ease of handling a groove 26 is disposed around the outer surface of the lid where the top and skirt 14 join. The depth of the groove approximately equals the thickness of the lid, as at a, which in the illustrated embodiment is 0.03 inches. Further in the illustrated embodiment 10, a reverse taper of an angle of about 1° as at 36, may be provided to the skirt 14 to promote resiliency and the engagement of the wedge shaped bead element strips under the lip 32 of the container associated with the top 10. Accordingly, the outer surface of the skirt 14 of the illustrated embodiment 10 tapers slightly toward the center of the lid.

The lid embodiments 10 are readily placed by packaging equipment on 8 once capacity cups containing a food product such as margarine. The filled, assembled containers may be placed in cardboard packaging sleeves (two containers per sleeve) and packaged and shipped in shipping cartons in stacked relationship (four layers) without interlayer cardboard spacers, without substantial product damage.

To test certain of the rigidity characteristics of the lids 10, a number of margarine lids dimensionally like that of FIGS. 1–5 are injection molded using a propylene polymer sold by Shell Oil Co. under the trade designation Shell 7525 Copolymer PP. The lids are subjected to horizontal flexure testing by setting them horizontally on blocks spaced $2\frac{7}{8}$ inches apart and a template is pressed into the middle of the lid at a speed of 0.1 inch per minute (room temperature). The lids have a ridigity indicated by an average horizontal flex at $\frac{1}{4}$ inch deflection, of 7.5 pounds (range 7.3–7.77 pounds). A number of vertically oriented lids are similarly subjected to compressional flex measurements at a room temperature compression rate of 0.1 inch per minute, and are found to have an average maximum force to flex the lids of 3.4 pounds (range 3.3–3.5 pounds). In stacking tests, 3 assembled 8 ounce cups and lids are stacked, and the average force to cause $\frac{1}{4}$ inch deflection is similarly found to be 11.3 pounds (range 11.0–12.0 pounds). The deflection of the stacked units at 25 pounds of force is found to be an average of 0.4 inches (range 0.375–0.440 inches).

While the present invention has been shown and described with respect to a specific preferred embodiment thereof, it should be apparent that various modifications, adaptations and variations may be made utilizing the teachings of the present disclosure without departing from the scope of the invention, and are intended to be within the scope of the following claim.

Various of the features of the invention are set forth in the following claims.

What is claimed is:

1. A rigid organopolymeric lid for an associated wide mouthed container having an outwardly projecting lip for engagement therewith comprising:

a circular top panel having a diameter in the range of from about 3 inches to about 6 and one-half inches, a generally cylindrical skirt depending from said top panel having an inner diameter approximating the outer diameter of said container lip, a plurality of at least about 6 regularly spaced bead elements projecting inwardly from said skirt and spaced apart from said top panel to form an interrupted bead at regularly spaced intervals along the inner surface of said skirt, said bead elements having a total length along the inner circumference of said skirt in the range of from about 60 to about 90 percent of the length of said inner circumference of said skirt, said top panel, skirt and bead elements being integrally formed of a rigid organopolymer having a flexural modulus of elasticity of at least about $1.5\times10^5$ psi, and said lid having a rigidity to flexure such that a centrally applied flexure force of at least about 6 pounds is required to deflect said lid one quarter inch when supported at a support spacing of $2\frac{7}{8}$ inches, said lid having a rigidity such that the maximum force applied by flat compression elements at a compression speed of 0.1 inch per second to flex said lid in compression is at least about 3 pounds, and said regularly spaced bead elements providing for secure closure to said associated wide mouthed container while permitting ready removal and replacement of said lid in respect to said container.

2. A rigid lid in accordance with claim 1 wherein said lid is made from an organic polymeric material having a flexural modulus at ambient temperature in the range from about $1.5\times10^5$ psi to about $2.25\times10^5$ psi.

3. A rigid lid in accordance with claim 1 wherein an abutment member depends from the inner surface of the top.

4. A rigid lid in accordance with claim 1 wherein said bead elements have tapered ends.

5. A rigid lid in accordance with claim 1 wherein said cylindrical skirt has a reverse taper of about 1°.

* * * * *